US006699014B1

(12) United States Patent
Lam et al.

(10) Patent No.: US 6,699,014 B1
(45) Date of Patent: Mar. 2, 2004

(54) QUICK CONNECT DEVICE FOR CEILING FAN BLADE AND METHOD THEREFOR

(75) Inventors: Hei Yan Lam, Kowloon (HK); Wai Nan Leung, Kowloon (HK)

(73) Assignee: DHI Acquisition Corp., Mequon, WI (US)

( * ) Notice: Subject to any disclaimer, the term of this patent is extended or adjusted under 35 U.S.C. 154(b) by 18 days.

(21) Appl. No.: 10/052,229

(22) Filed: Jan. 16, 2002

(65) Prior Publication Data

(65)

(51) Int. Cl.[7] ..... F04D 29/34

(52) U.S. Cl. ..... 416/5; 416/210 R; 416/220 A; 416/221

(58) Field of Search ..... 416/5, 204 R, 416/205, 206, 207, 210 R, 219 R, 220 R, 221, 220 A, 219 A, 244 R, 248

(56) References Cited

U.S. PATENT DOCUMENTS

| | | | | |
|---|---|---|---|---|
| 5,927,945 A | | 7/1999 | Chen | 416/210 R X |
| 5,980,353 A | | 11/1999 | Wu | 416/210 R |
| 6,048,173 A | | 4/2000 | Chen | 416/210 R |
| 6,059,531 A | | 5/2000 | Tai | 416/210 R |
| 6,062,820 A | | 5/2000 | Wang | 416/210 R |
| 6,095,753 A | | 8/2000 | Hsu | 416/210 R |
| 6,139,276 A | * | 10/2000 | Blateri et al. | 416/210 R |
| 6,241,475 B1 | | 6/2001 | Blateri et al. | 416/210 R |
| 6,347,924 B1 | * | 2/2002 | Chang | 416/210 R |
| 6,378,824 B1 | * | 4/2002 | Tseng | 416/210 R X |
| 6,390,777 B1 | * | 5/2002 | Kerr, Jr. | 416/204 R |

* cited by examiner

*Primary Examiner*—Edward K. Look
*Assistant Examiner*—Richard A. Edgar
(74) *Attorney, Agent, or Firm*—Nicholas A. Kees; Godfrey & Kahn, S.C.

(57) ABSTRACT

An attachment mechanism for mounting fan blades to a ceiling fan, characterized in that a ring is attached to the bottom of the motor housing, the ring having a plurality of dovetailed recesses spaced equally apart. A tongue is located on an end of each fan blade, the tongue having a corresponding dovetail shape such that the tongue can be inserted into a recess. A biasing member is located between the recess and tongue to provide a bias that prevents undue vibration.

17 Claims, 6 Drawing Sheets

QUICK CONNECT DEVICE FOR CEILING FAN BLADE AND METHOD THEREFOR

FIELD OF THE INVENTION

This invention relates to a connecting device, more particularly to a connecting device for connecting a fan blade to a ceiling fan rotor.

BACKGROUND OF THE INVENTION

Ceiling fans have been popular for many years. However, conventional ceiling fans typically are not convenient to install. If the fan blades are not installed properly, the fans tend to vibrate and create a significant amount of noise. Referring to FIG. 1, a conventional ceiling fan 10 is shown to include an outer casing 12 for housing a motor 14, a plurality of fan blades 16 (only one is shown), and a plurality of mounting arms 18 (only one is shown) for connecting the fan blades 16 to the bottom of the motor's rotor 20. Each mounting arm 18 has two ends which are respectively secured on the corresponding fan blade 16 and the bottom of the rotor 20 by screw fasteners 22, 24.

The use of screw fasteners 22, 24 tend to make if inconvenient to assemble the mounting arms 18. Insufficient tightening of the screw fasteners 22, 24 can result in vibration of the mounting arms 18 and even discharge of the fan blades 16 from the rotor 20 during operation. Dynamic imbalance and vibration can even occur when screw fasteners 22, 24 are tight, but tightened in the wrong order. These variables can be frustrating for the do-it-yourself homeowner that simply wants to install a ceiling fan.

Recent fans have been designed to make it easier for the do-it-yourself installer. One such fan is disclosed in U.S. Pat. No. 6,095,753 to Hsu, and has a structure for mounting ceiling blades that does not require screws for attaching the blade to a ring mount on the rotor. The ring mount has a plurality of recesses having an inner end that gradually decreases in width toward an outer end. Each blade has a tongue that is configured so that its outer end is the same width as the outer end of a corresponding recess. The tongue inner end is also configured so that its width is the same size as the inner end of the corresponding recess. The blades slidingly connect to the rotor without the use of tools, and centrifugal force keeps the blades from being dislodged during operation. When the fan is not in motion, the blades can be removed by sliding each blade toward the inner end of a corresponding recess. While this is a convenient connection with respect to ease of assembly and disassembly, it requires exact tolerances for parts. If the tongue and recess do not fit together properly, then annoying and possibly dangerous blade vibration can occur.

Another such fan is disclosed in U.S. Pat. No. 5,980,353 to Wu. This fan also requires close tolerances so that the plug end of the blade does not vibrate with respect to the insert slot. Further, vibration can occur if each rotor mounting segment is not fastened properly to the motor or motor casing.

Accordingly, a need exists for ceiling fan having a simple attachment mechanism for attaching the fan blades to the rotor without using tools that can be manufactured without meeting exact tolerances.

SUMMARY OF THE INVENTION

The present invention comprises an impeller and blade assembly. A ring, including a plurality of dovetailed recesses that have a ceiling and two side walls is mounted onto the impeller. A biasing member such as a spring is secured to each recess's ceiling. Each fan blade is constructed from a wing connected to an arm, that has a dovetailed tongue corresponding to one of the recesses. Each tongue can be made to engage one of the dovetailed recesses without the use of a tool. The biasing member provides a bias between the tongue and recess sidewalls to prevent undue vibration therebetween. The biasing member or spring also locks the tongue into the recess to prevent accidental radial displacement. Thus, a tongue cannot move in a substantially radial direction with respect to the ring without applying pressure to the spring. The advantage of this invention is quick and easy installation, and increased safety and satisfaction due to reduced vibration.

While the present invention is particularly useful for ceiling fans, other applications are possible and references to use with ceiling fans should not be deemed to limit the application of the present invention. The present invention may be advantageously adapted for use where similar performance capabilities and characteristics are desired. These and other objects and advantages of the present invention will become apparent from the detailed description, claims, and accompanying drawings.

DETAILED DESCRIPTION

The present invention provides, among other things, a new and improved ceiling fan including an attachment assembly for engaging fan blades with a rotating ring. The present invention is useful with all types of conventional fans. However, the invention is particularly useful for use with convention ceiling fans for permitting the easy installation of ceiling fan blades.

Figure 1:
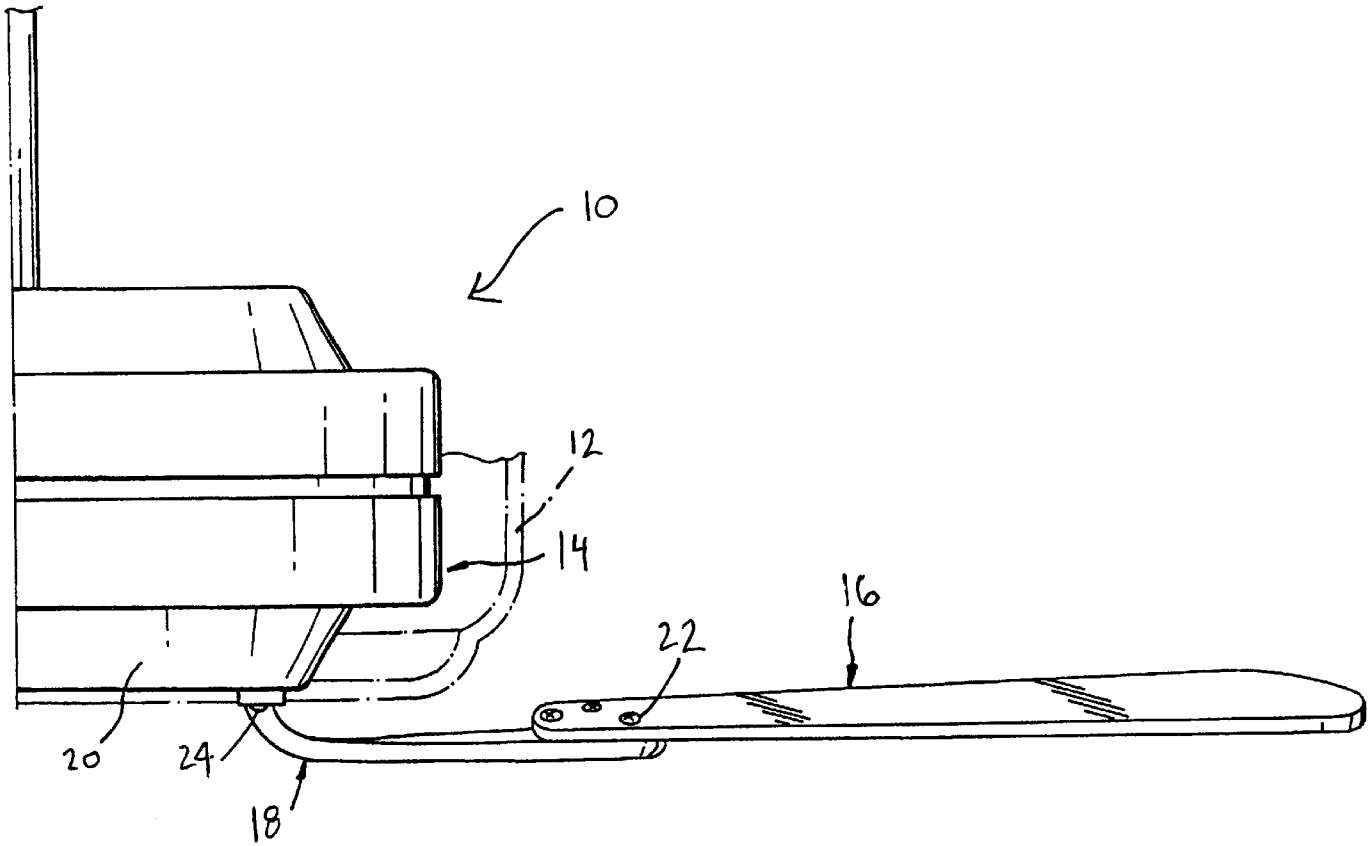
FIG. 1 PRIOR ART
FIG. 1 is a partial side elevational view of a prior art fan blade assembly.
Figure 2A:
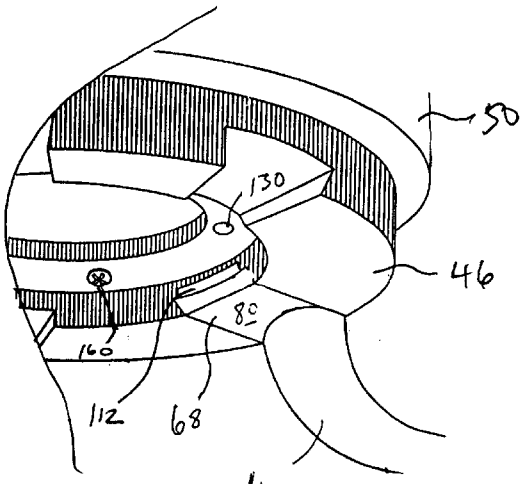
FIG. 2A is a partial perspective view of the fully assembled blade attachment shown in FIG. 2.
Figure 2:
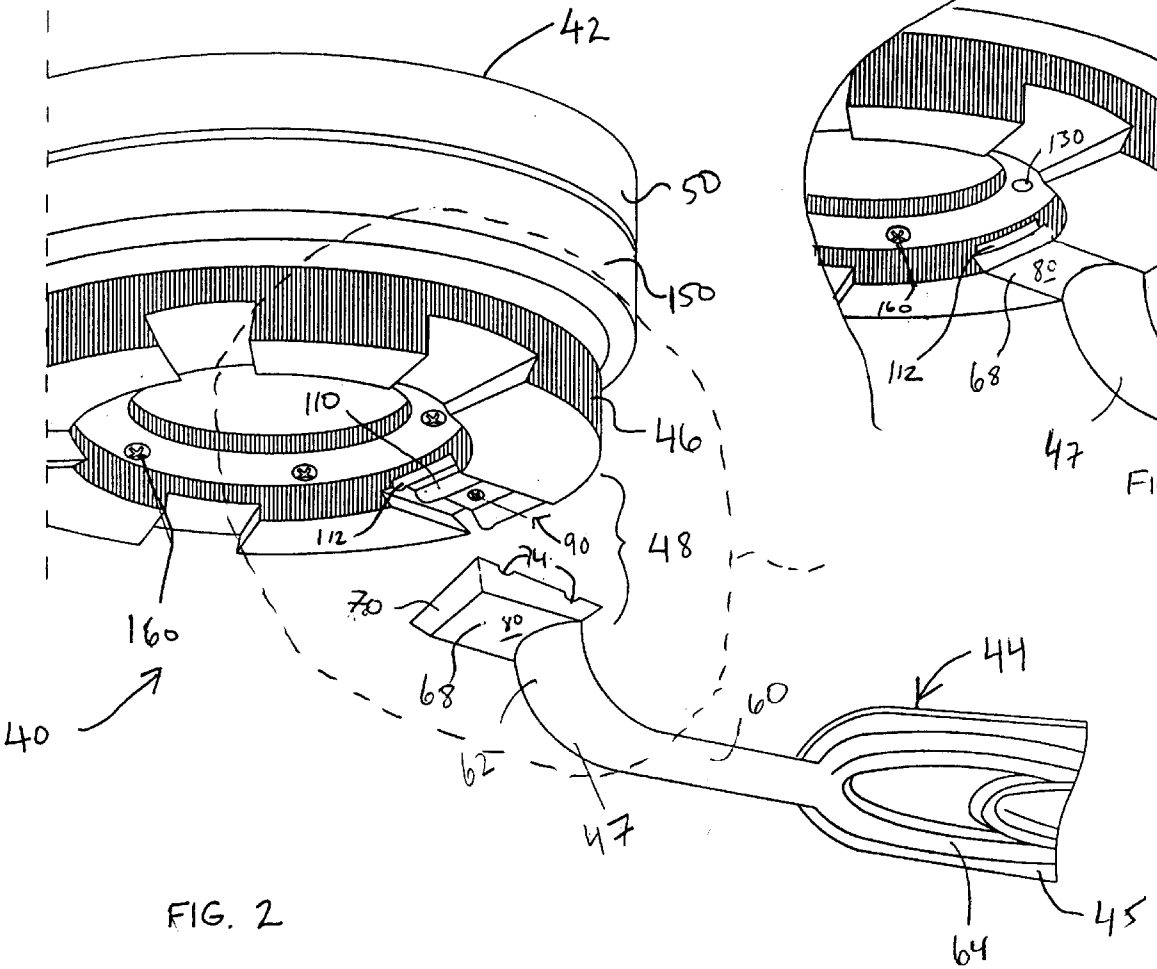
FIG. 2 is a perspective view of a ceiling fan with a partially assembled blade attachment mechanism of an embodiment of the present invention.

As shown in FIG. 2, a fan 40 has an impeller or rotor 42 including a plurality of fan blades 44 (only one shown) for displacing air. Each fan blade 44 is engaged to ring 46 by an attachment assembly or mechanism 48. In this specific example, fan 40 is of a type commonly referred to as a ceiling fan with impeller or rotor 42 shown as it would appear in a decorative housing 50 and suspended for rotation from, for instance, a ceiling (not shown). In accordance with conventional practice, ring 46 may be rotated by a conventional electric motor or other suitable power source.

Figure 3:
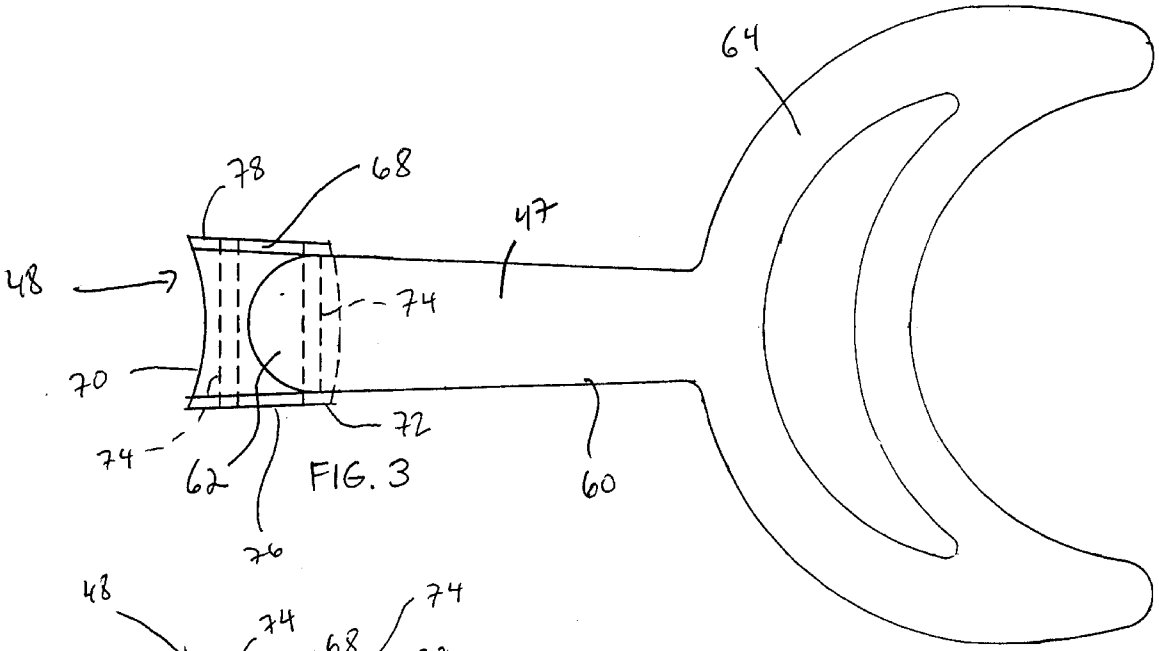
FIG. 3 is a bottom side view of the fan blade bracket shown in FIG. 2.
Figure 4:
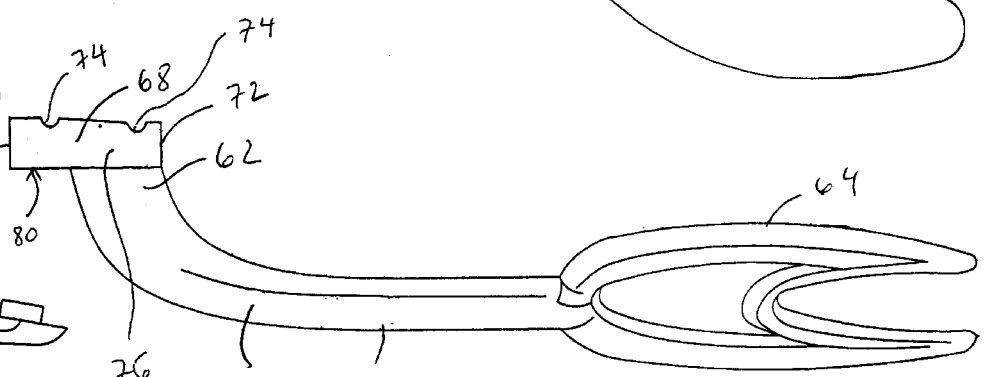
FIG. 4 is a side elevational view of the fan blade bracket shown in FIG. 3.
Figure 5:
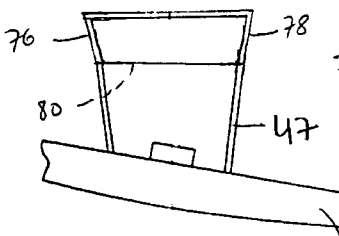
FIG. 5 is a front elevational view of the fan blade bracket shown in FIG. 4.

Referring now to FIG. 3, each fan blade 44 is generally comprised of a wing 45 connected to a connecting member such as an arm 47. Such connection may be integral (i.e. a unitary molded piece, not shown) or may be accomplished with fasteners. Arm 47 has an elongate body 60 with a proximal end 62, a distal end 64 and a tongue 68 carried by elongate body 60 adjacent proximal end 62. Tongue 68 is configured so that it extends outwardly and upwardly from proximal end 62, its inner end 70 gradually decreasing in width toward its outer end 72. The upper surface of tongue 68 has a pair of substantially parallel grooves 74 extending between side is 76 and side 78. As best seen on FIGS. 2 and 5, tongue 68 gradually increases in width as it extends upwardly from its bottom surface 80. Thus, tongue 68 is "dovetailed" in both a vertical and horizontal direction.

Figure 6:
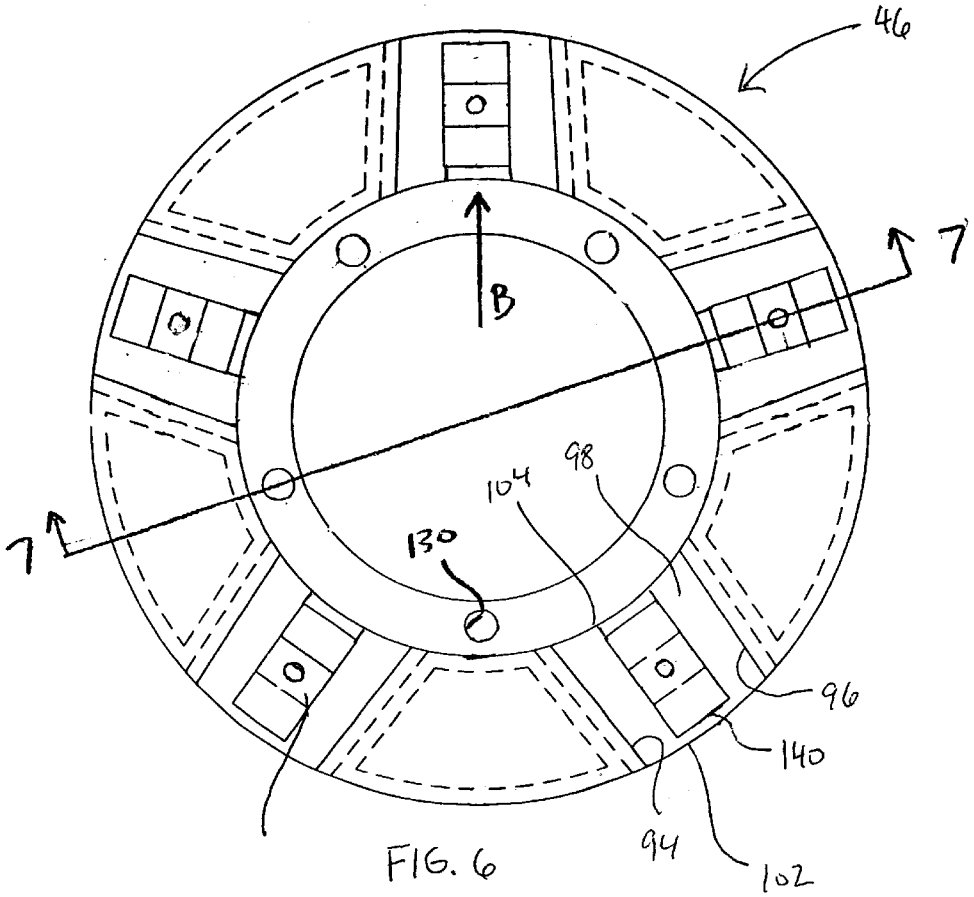
FIG. 6 is a bottom side view of the ring portion of an embodiment of the present invention as shown in FIG. 2.
Figure 7:
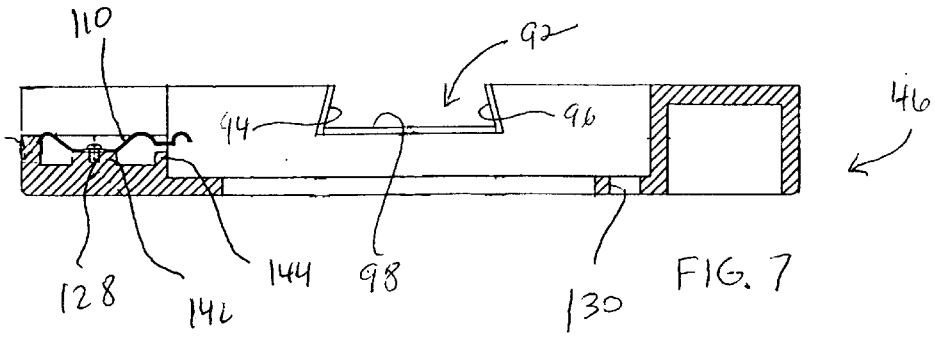
FIG. 7 is a side cross-sectional view taken at lines 7—7 in FIG. 6.

A plurality of complementary engagement assemblies 90 of each attachment mechanism 48 are carried or otherwise supported by ring 46 at spaced radial intervals. Referring also to FIGS. 6 and 7, each complementary engagement assembly includes a recess 92 defined by sidewalls 94 and 96, and ceiling 98. Recess 92 extends into ring 46 for receiving tongue 68 of a selected one of fan blades 44. As such, the outer end 102 of recess 92 is the same width as outer end 72 of tongue 68, and the inner end 104 is the same width as inner end 70 of tongue 68. Thus, recess 92 is "dovetailed" in both the vertical, and horizontal direction in the same fashion as recess 92. Preferably, the tolerance between tongue 68 and recess 92 is a slip fit.

Referring to FIGS. 2 and 6, a spring 110 is mounted in recess 92 for providing a bias against tongue 68 after the fan is assembled; the spring 110 biases the tongue 68 against at least one of the side walls defining the recess. Such bias prevents undue vibration due to the tolerances between tongue 68 and recess 92. The spring 110 also serve to selectively lock the tongue 68 into recess. Preferably, spring 110 is constructed from a spring steel or metals having similar qualities. Spring 110 may have various configurations that fit against tongue 68; only one possible embodiment is depicted. Regardless of the exact configuration, it is preferable that spring 110 have three ridges thereon: a stop 112, a mid-ridge 114 and an end-ridge 116. Between end ridge 116 and mid-ridge 114 is a flat section 118 with an aperture 120 for the purpose of mounting spring 110 to the ceiling 98 of ring 46. Also, between mid-ridge 114 and stop 112 is a second flat portion 124. The purpose of stop 112 is to prevent tongue 68 from accidentally moving toward the rotational axis 119 of the fan, see FIG. 10. Mid-ridge 114 and end-ridge 116 are configured to engage grooves 74 in tongue 68. Spring 110 has enough stiffness whereby the sides 76, 78 of tongue 68 are pressed firmly against sides 94, 96 of recess 92. As a result, when the fan is in operation, there is negligible vibration between tongue 68 and recess 92, and little or no unwanted noise.

Ring 46, preferably, is made from a die-cast zinc alloy or of metals with similar properties and is shown in detail in FIGS. 6 and 7. As mentioned previously, ring 46 has a plurality of recesses 92, which are preferably spaced evenly apart to prevent a dynamic imbalance during fan operation.

In a more preferred embodiment of the present invention, the recess ceiling 98 is not flat as shown in FIG. 2, but instead has a secondary recess 140 for seating spring 110. Recess 140 is substantially centrally located on ceiling 98, and has a mount 142, and fastener 128 to accommodate spring flat portion 118, and a stop pad 144 to limit movement of stop 112 when spring 110 is flexed. The width of secondary recess 140 matches that of spring 110, and has a tolerance that allows spring flexure. Ring 46 also has a plurality of evenly spaced apertures 130 to accommodate fasteners for attachment to motor housing 50.

Figure 10:
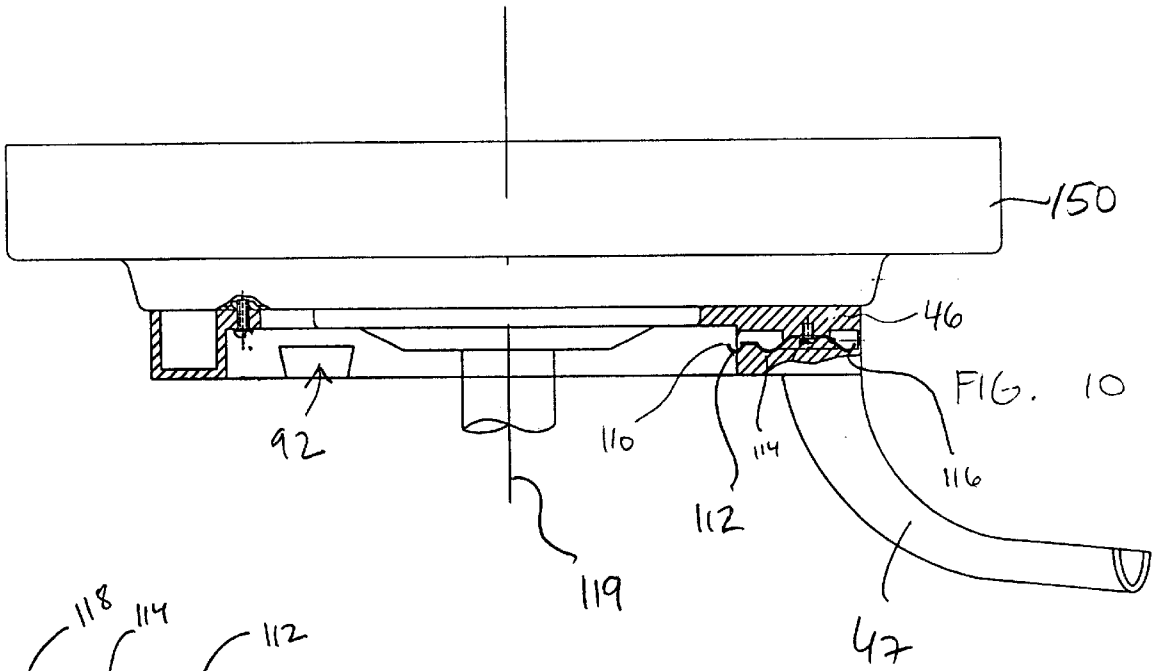
FIG. 10 is a partial side elevational view of the ceiling fan shown in FIG. 2, with the ring portion as shown in FIG. 7.
Figure 9:
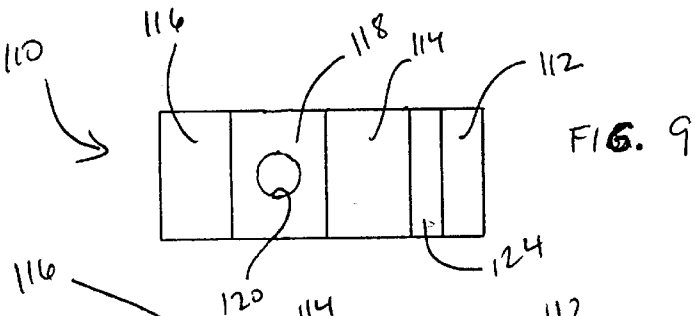
FIG. 9 is a plan view of the spring shown in FIG. 8.
Figure 8:
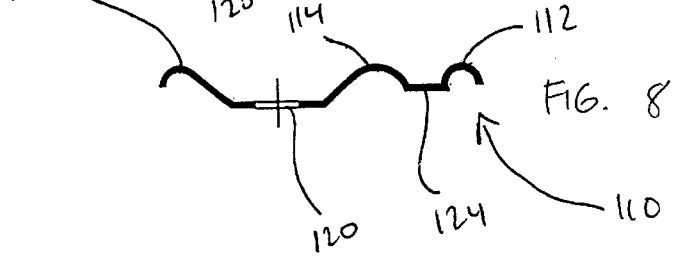
FIG. 8 is a side elevation of a spring of an embodiment of the present invention as shown in FIG. 2.
Figure 11:
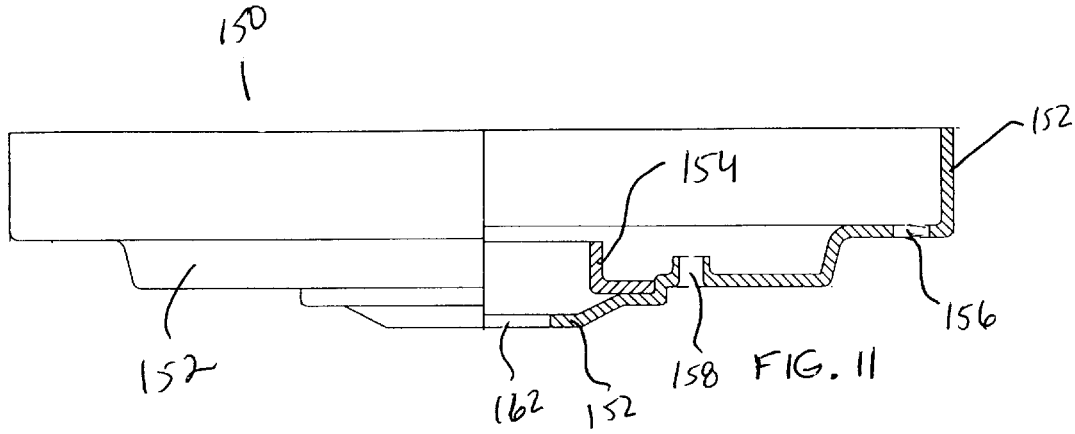
FIG. 11 is a side elevational, partial cross-section of an optional motor housing adapter of an embodiment of the present invention.
Figure 12:
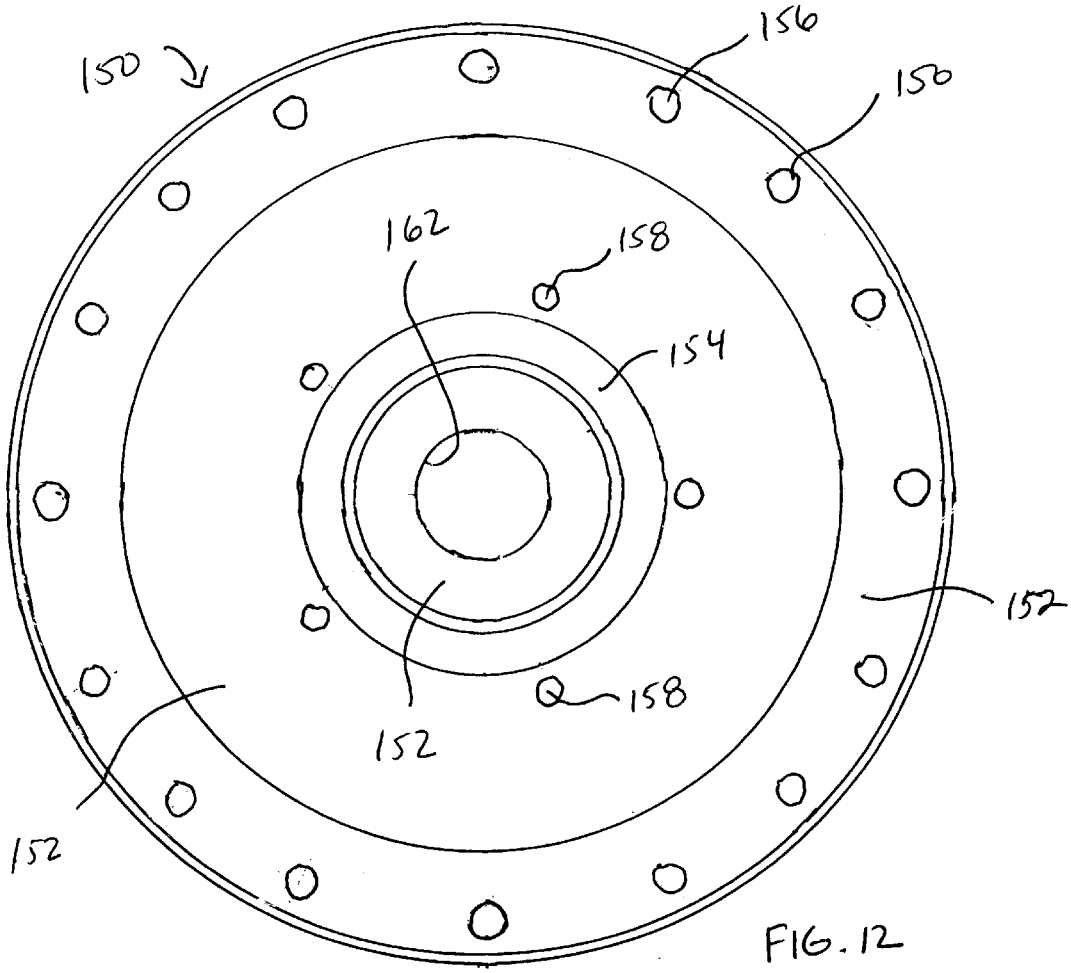
FIG. 12 is a plan view of the adapter shown in FIG. 11.

An optional motor housing adapter 150 is shown in FIGS. 10 through 12. In cases where the arm 27, spring 110, ring 46 are sold as a kit to ceiling fan manufacturers, the adapter 150 similar to that shown may be necessary to for fitting the ring 46 to a stock motor housing 50. This adapter 150 may replace the lower portion of a stock motor housing 50 (see FIG. 2). Adapter 150 may be manufactured from a stamped or die-cast metal, and is generally constructed from two pieces, a main body 152 and an inner cap 154. The two pieces are preferably connected by rivets or spot welds (neither shown). Apertures 156 are evenly distributed on the adapter 150 for mounting it to the stock housing 50. Apertures 158 are located on the adapter so that they correspond to apertures 130 on ring 46. Fasteners 160 are used to connect ring 46 to adapter 150 as seen in FIG. 2 (or alternatively, directly to a stock motor housing 50 as seen in FIG. 2A.) Adapter 150 may include a center aperture 162 to accommodate a light fixture (not shown).

Preferably, the ceiling fan is shipped to the consumer so that no tools are required for assembly. For instance, the ring 46 may be already be connected to rotor 42 and arm 47 already connected to wing 45. The spring 110 may already be connected to ring 46, preferably with a locking-type fastener. In such case, assembly by the consumer, a selected one of fan blades 44 may be grasped and tongue 68 directed toward one of the recesses 92 as shown substantially in FIG. 2. Each tongue 68 is introduced into a corresponding recess 92 in the direction generally indicated by arrow B in FIG. 6, which can be described as a radial direction with respect to ring 46. As tongue 68 is urged into recess 92, it will abut against sidewalls 94 and 96 and overcome the bias of compression spring 110. Tongue 68 will snap into place once mid-ridge 114 and end-ridge 116 of spring 110 are aligned with tongue grooves 74. The "snap" generally occurs when the stop on the spring moves from a flexed position to a non-flexed position. FIG. 2A shows tongue 68 assembled with ring 46. For disassembly, spring stop 112 is pushed toward the motor housing 50 in a direction substantially parallel to the rotational axis 119 (see FIG. 10), and the tongue 68 is pulled out of recess 92 in the direction opposite from which it was inserted.

Existing ceiling fans may be retrofitted with the present invention. For example, a kit may be provided for such purposes, the kit including the biasing member or spring 110, the ring 46 adapted to engage an existing fan impeller or rotor 42, and a fan blade arm 45 having a tongue 68 at one end. The tongue 68 is configured to fit into the recess 98 and against the spring 110 when assembled with the ring 46.

In summary, the present invention provides an attachment mechanism for detachably engaging fan blades with a rotating ring of, for instance, a ceiling fan without the use of tools. Although the invention has been herein shown and described in what is perceived to be the most practical and preferred embodiments, it is to be understood that the invention is not intended to be limited to the specific embodiments set forth above. Accordingly, it is recognized that modifications may be made by one skilled in the art of the invention without departing from the spirit or intent of the invention and therefore, the invention is to be taken as including all reasonable equivalents to the subject matter of the appended claims.

What is claimed is:

1. A method for assembling a plurality of fan blades to a rotor, wherein a ring with a plurality of dovetailed recesses is connected to the rotor, each of the dovetailed recesses having a spring mounted therein, and each fan blade has a dovetailed tongue at a proximal end that corresponds to one of the dovetailed recesses in the ring, the method comprising the step of:

slidingly engaging one of the dovetailed tongues with one of the plurality of dovetailed recesses in a radial direction with respect to the ring, until the spring prevents radial movement of the dovetailed tongue in a reverse radial direction, and that ridges located on the spring engage corresponding grooves located on the dovetailed tongue.

2. The method of claim 1 wherein the step of slidingly engaging is performed until the spring moves from a flexed position to a non-flexed position and the dovetailed tongue snaps into place; and further including a step of disassembly of the fan blade from the rotor, comprising: applying pressure to a spring stop so that it flexes away from the dovetailed tongue, and urging the dovetailed tongue out of the recess in a reverse radial direction.

3. An attachment assembly for a ceiling fan comprising:

a biasing member having three ridges thereon and a flat portion;

a ring having a plurality of dovetailed recesses therein, the dovetailed recess comprising a pair of side walls and a ceiling having a secondary recess for receiving the biasing member as it flexes;

a fan blade arm having a tongue at one end, wherein the tongue is configured to fit into the dovetailed recess and is biased against at least one of the side walls by the biasing member when assembled with the ring.

4. The assembly of claim 3 wherein, the secondary recess has mount to which the biasing member is engaged, and a stop pad to limit flexure of the biasing member.

5. The assembly of claim 3 wherein the ring is die-cast and adapted to fit against a motor housing.

6. The assembly of claim 3 wherein the ring is die-cast and adapted to fit against a motor housing adaptor.

7. The assembly of claim 3 wherein the three ridges are, namely a stop, a mid-ridge and an end-ridge.

8. The assembly of claim 7 wherein the tongue has a pair of grooves that engage the biasing member mid-ridge and the biasing member end-ridge when the tongue is assembled with the ring, and the biasing member stop is adjacent an inner end of the tongue when the tongue is assembled with the ring.

9. The assembly of claim 7 wherein the biasing member is attached to the ring with a locking-type fastener.

10. An impeller and fan blade assembly comprising:

a ring mounted onto the impeller, wherein the ring includes a plurality of recesses, each one of said plurality of recesses defined by only a ceiling and two side walls, and wherein the ring further includes a secondary recess in each ceiling, each secondary recess having a mount to which a biasing member comprising a spring is secured, and a stop pad to limit flexure of the spring; a plurality of fan blades with a connecting member, each connecting member connected to one of the plurality of recesses without the use of a tool and selectively removable from its respective recess by applying pressure to the biasing member in a direction substantially parallel to a rotational axis of the ring;

wherein the connecting member is an arm with a tongue extending therefrom that corresponds to any one of the plurality of recesses so that each tongue can selectively engage one of the plurality of recesses; and wherein the biasing member biases the connecting member against at least one of the side walls.

11. The assembly of claim 10 wherein the ring is die cast and the spring is configured to have three ridges thereon, namely a stop, a mid-ridge and an end-ridge.

12. The assembly of claim 11 wherein the tongue has a pair of grooves that engage the spring mid-ridge and the spring end-ridge when the tongue is assembled with the ring.

13. The assembly of claim 11 wherein the spring stop is adjacent an inner end of the tongue when the tongue is assembled with the ring.

14. An impeller and blade assembly comprising:

a ring mounted onto the impeller, the ring including a plurality of recesses having a ceiling and two side walls, wherein the side walls converge away from the ceiling, and the side walls also converge in an outward radial direction with respect to the ring;

a biasing member secured to each ceiling, wherein the biasing member is a spring; and the ring further includes a secondary recess in the ceiling, the secondary recess having a mount to which the spring is secured, and a stop pad to limit flexure of the spring; and a plurality of fan blades each connected to an arm, wherein each arm has a tongue and sides that converge in a corresponding manner to side walls of the plurality of recesses;

wherein each tongue can be made to engage the biasing member secured within one of the plurality of recesses without the use of a tool so that the tongue is biased against the side walls by the biasing member.

15. The assembly of claim 14 wherein the ring is die-cast, and the spring is configured to have three ridges thereon, namely a stop, a mid-ridge and an end-ridge.

16. The assembly of claim 15 wherein the tongue has a pair of grooves that engage the spring mid-ridge and the spring end-ridge when the tongue is assembled with the ring.

17. The assembly of claim 15 wherein the spring stop is adjacent an inner end of the tongue when the tongue is assembled with the ring.

* * * * *